United States Patent [19]

Holleyman

[11] Patent Number: 4,896,505

[45] Date of Patent: Jan. 30, 1990

[54] PRESSURIZED-FLUID-OPERATED ENGINE

[76] Inventor: John E. Holleyman, 3402 Polk St., Monroe, La. 71202

[21] Appl. No.: 293,183

[22] Filed: Jan. 3, 1989

[51] Int. Cl.[4] ..... F16D 31/02

[52] U.S. Cl. ..... 60/370; 60/407; 417/65

[58] Field of Search ..... 60/370, 407, 409, 412, 60/413, 416; 417/77, 79, 65, 87; 91/436

[56] References Cited

U.S. PATENT DOCUMENTS

| | | | |
|---|---|---|---|
| Re. 21,416 | 4/1940 | Sargent . | |
| 664,456 | 12/1900 | Barry et al. . | |
| 1,511,048 | 10/1924 | Cauthery et al. . | |
| 2,164,263 | 6/1939 | Wall . | |
| 2,172,522 | 9/1939 | Sline . | |
| 3,047,267 | 7/1962 | Peyrin . | |
| 3,730,646 | 5/1973 | Affri et al. | 417/77 |
| 3,925,984 | 12/1975 | Holleyman . | |
| 4,051,680 | 10/1977 | Hall . | |
| 4,089,177 | 5/1978 | Olofsson . | |
| 4,162,614 | 7/1979 | Holleyman . | |
| 4,208,592 | 6/1980 | Leibow et al. | 60/407 X |
| 4,507,918 | 4/1985 | Holleyman . | |
| 4,697,419 | 10/1987 | Jeffery et al. | 60/464 |
| 4,769,988 | 9/1988 | Clark, Jr. | 60/370 |

FOREIGN PATENT DOCUMENTS

| | | | |
|---|---|---|---|
| 83/00190 | 1/1983 | PCT Int'l Appl. | 60/412 |
| 321933 | 11/1929 | United Kingdom | 60/412 |

*Primary Examiner*—Edward K. Look

*Attorney, Agent, or Firm*—Laurence R. Brown; Alfred J. Mangels

[57] ABSTRACT

A pressurized-fluid-operated engine having a plurality of reciprocatable pistons carried within cylinders through connecting rods with an output shaft. The engine is adapted to operate on pressurized air or pressurized gases, without combustion, and it includes a recirculation device of the ejector type to provide recirculation of a part of the lower pressure exhaust gas and to permit mixing of the recirculated exhaust gas with incoming inlet gas. The device is particularly adapted for use where the source of compressed gas provides a very high pressure of gas, but a relatively low volume, and it permits the mixing of very high pressure inlet gas with lower pressure exhaust gas to provide an operating gas a sufficiently high level to provide a desired engine output.

8 Claims, 4 Drawing Sheets

PRESSURIZED-FLUID-OPERATED ENGINE

BACKGROUND OF THE INVENTION

1. Field of the Invention

The present invention relates to engines that are operated by a pressurized fluid to provide a usable work output. More particularly, the present invention relates to an improved form of pressurized-fluid-operated engine in which a portion of the exhausted fluid is recycled and mixed with incoming pressurized fluid to provide greater efficiency.

2. Description of the Related Art

Engines in which power is derived from partially expanding a pressurized fluid to drive an output shaft are preferred over internal combustion engines because the latter generally involve the handling of volatile combustible fluids, such as gasoline, diesel fuel, and any of a number of combustible gases. Moreover, such internal combustion engines result in exhaust gases that are ecologically undesirable, because they could possibly cause air pollution and sometimes health risks, depending upon the combustion products that result from the combustion process and depending upon the completeness of combustion. Additionally, such internal combustion engines require complex fluid metering systems to meter the combustible fluid in the proper amounts for proper combustion, and because of the generation of significant heat, such engines usually require some type of engine-driven cooling system in order to avoid overheating of the engine components.

Engines utilizing pressurized gases, such as compressed air and natural gas provided under pressure, can be used to power an engine by virtue of the pressure of the gas, and without combustion, to overcome the disadvantages of the internal combustion process. Examples of such pressure-fluid operated engines are disclosed in the following U.S. Patents, each of which issued to John E. Holleyman, the inventor in the present application: U.S. Pat. No. 3,925,984, which issued Dec. 16, 1975, and is entitled: "Compressed Air Power Plant"; U.S. Pat. No. 4,162,614, which issued July 31, 1979, and is entitled: "Pressure Fluid Operated Power Plant"; and U.S. Pat. No. 4,507,918, which issued Apr. 2, 1985, and is entitled: "Reciprocating Piston Compressed Fluid Engine Having Radial Cylinders and Triggerable Valves."

Although the various engine constructions disclosed in the above-identified patents provide satisfactory results, it is desirable that the operating efficiency of such engines be further improved for greater commercial acceptability.

It is an object of the present invention to provide a pressure-fluid operated engine that has improved efficiency.

SUMMARY OF THE INVENTION

Briefly stated, in accordance with one aspect of the present invention, a pressure-fluid-operated reciprocating engine provides output power from a pressurized gas that expands within the engine without combustion. The engine includes an engine block that houses a plurality of cylinders within which respective pistons are reciprocatable, the pistons being connected by connecting rods to a crankshaft to provide a rotary power output. A suitable inlet arrangement is provided for introducing a pressurized gas into the respective cylinders in a predetermined, timed relationship to provide a smooth power output from the engine. An outlet arrangement is provided for conveying exhausted gases from the respective cylinders after the gas has expanded to move the pistons within the cylinders. A recirculation device extends between the inlet and outlet for recirculating a predetermined quantity of the exhaust gases back to the inlet. The recirculation device includes an ejector pump for drawing exhaust gas into the inlet, a first expansion section for mixing inlet gas and exhaust gas, and a second expansion section downstream of the first expansion section for additional mixing and partial expansion of the gas mixture for introduction into the respective cylinders.

DESCRIPTION OF THE PREFERRED EMBODIMENTS

Figure 1:
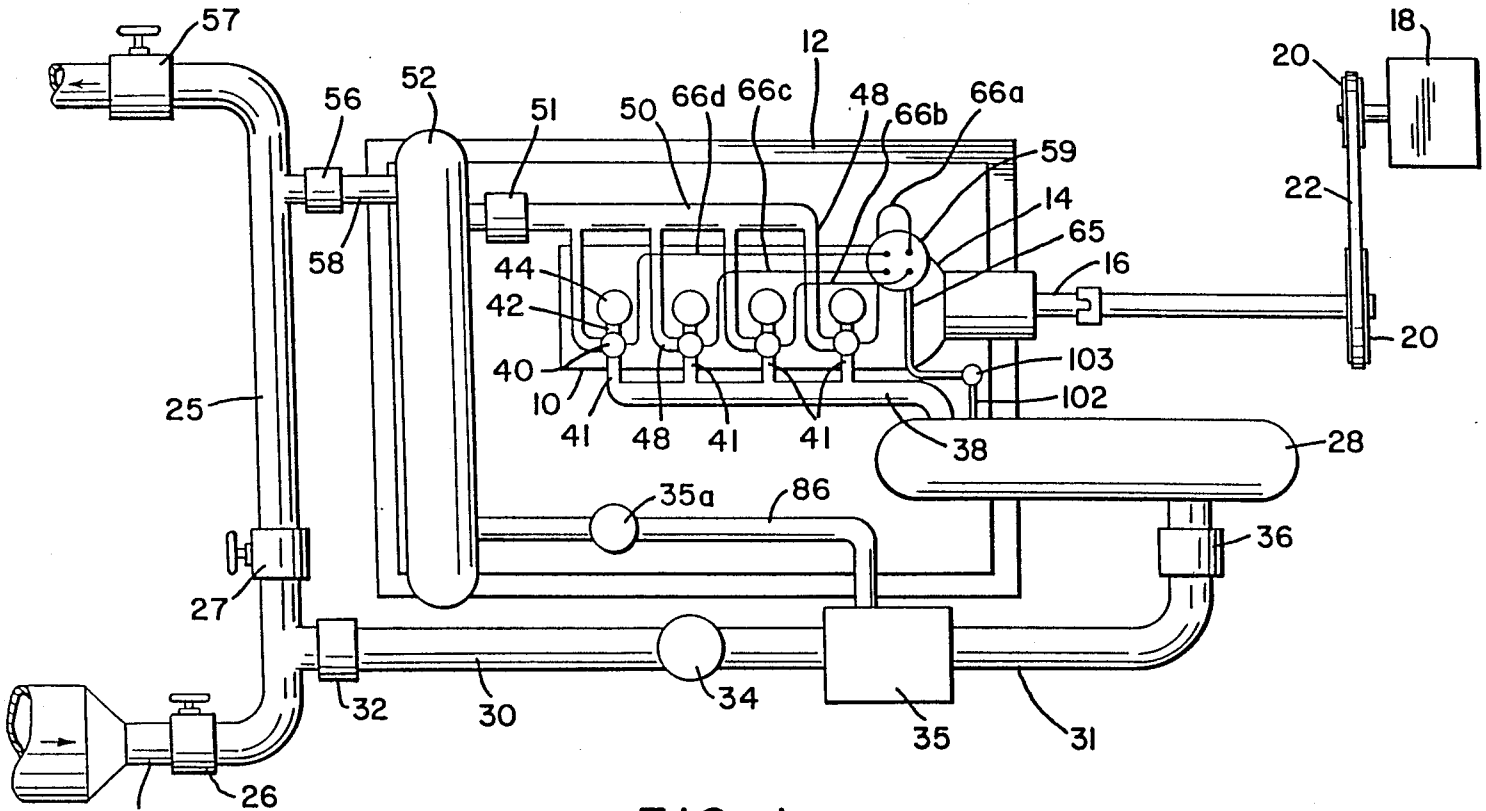
FIG. 1 is a top view of a pressurized-fluid-operated engine in accordance with the present invention showing the gas inlet and outlet arrangement and the power take off arrangement.

Referring now to the drawings, and particularly to FIG. 1 thereof, numeral 10 designates a pressurized-fluid-operated, piston-type engine which is suitably mounted on a frame 12 and includes a power transmission 14 and an output drive shaft 16 which can be connected to an output device 18, such as a generator, a sawmill, or the like, by a suitable drive means, such as gears or pulleys 20 and drive chains or belts 22.

Pressure fluid such as that from a gas well, a compressor, or other source (not shown) is conducted by an inlet pipe 24 having flow control valve 26, to a pressure tank 28 by a pipe 30 having an adjustable pressure regulator 32 and an oil separator 34 that is useful in the event oil is mixed with the inlet gas. The inlet pipe 24 also connects with a bypass pipe 25 having a cut-off valve 27.

Pressure tank 28 is employed to avoid pressure fluctuations in the inlet gas that flows to the engine and is provided with a check valve 36 to prevent reverse flow. The pressurized gas passes from pressure tank 28, through an inlet manifold 38, to a plurality of separate spool valves 40 each of which is connected by a separate pipe 42 to each of the respective motor cylinders 44, and the gas is exhausted from the engine by movement of the pistons (not shown) in the cylinders to cause the exhaust gas to pass from the cylinders through respective outlet pipes 48, to exhaust manifold 50, and through check valve 51 to an exhaust tank 52, which stabilizes the pressure of the exhaust gases. The gases then pass through an outlet check valve 56 in exhaust gas line 58 to a flow control valve 57, where it exits for normal use in commercial and residential applications.

Inlet pipe 30 includes a recirculation and mixing device 35 downstream of oil separator 34. The internal structure of the recirculating and mixing device will be hereinafter described in greater detail. A conduit 86 extends from exhaust tank 52 to recirculation device 35, and includes a check valve **35*a*** to prevent reverse flow from the inlet system into the outlet system.

Figure 2:
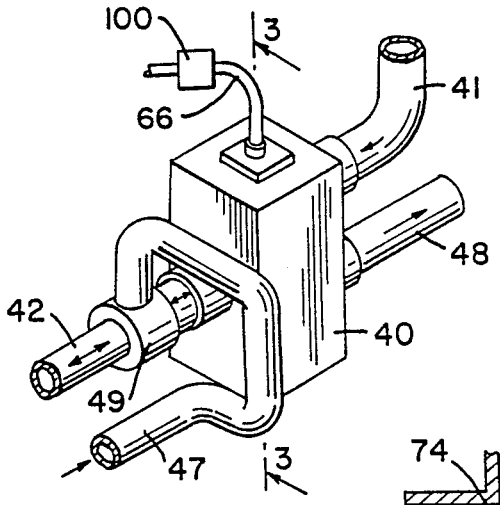
FIG. 2 is a fragmentary perspective view of a spool valve that functions as an inlet and an exhaust valve for the engine shown in FIG. 1.
Figure 3:
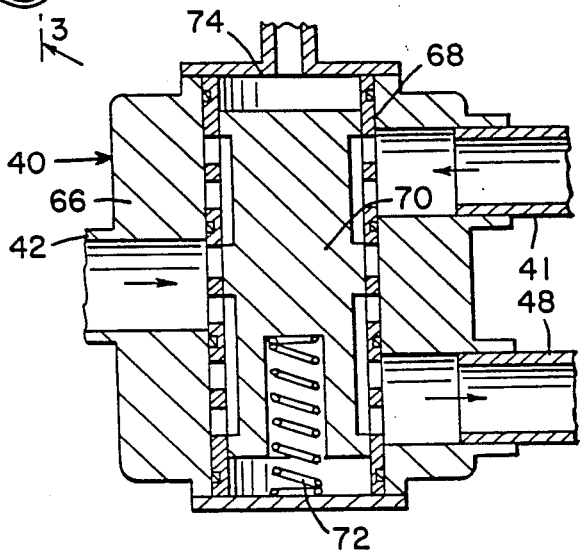
FIG. 3 is a longitudinal cross-sectional view of the valve shown in FIG. 2, taken along the line 3—3 thereof.
Figure 8:
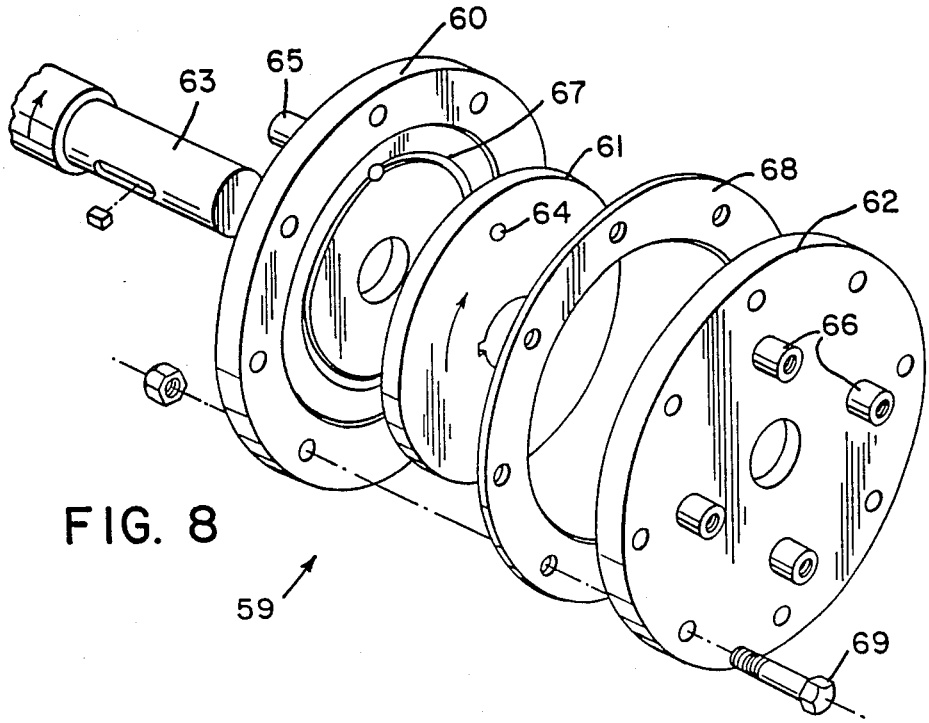
FIG. 8 is an exploded view of the fluid distributor shown in FIG. 4.
Figure 4:
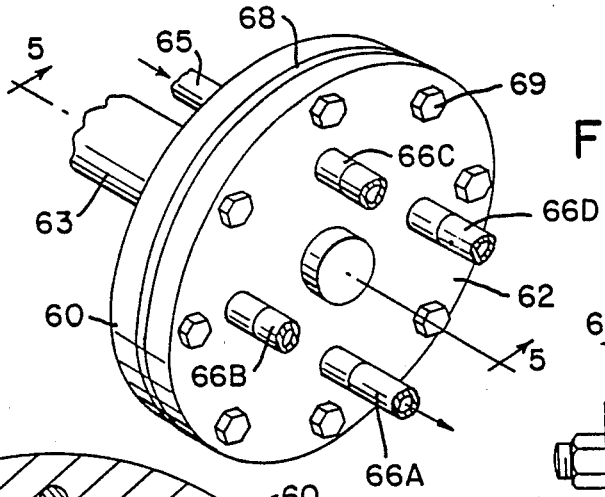
FIG. 4 is a perspective view of a fluid distributor for distributing inlet gas to the respective spool valves for the several cylinders.
Figure 6:
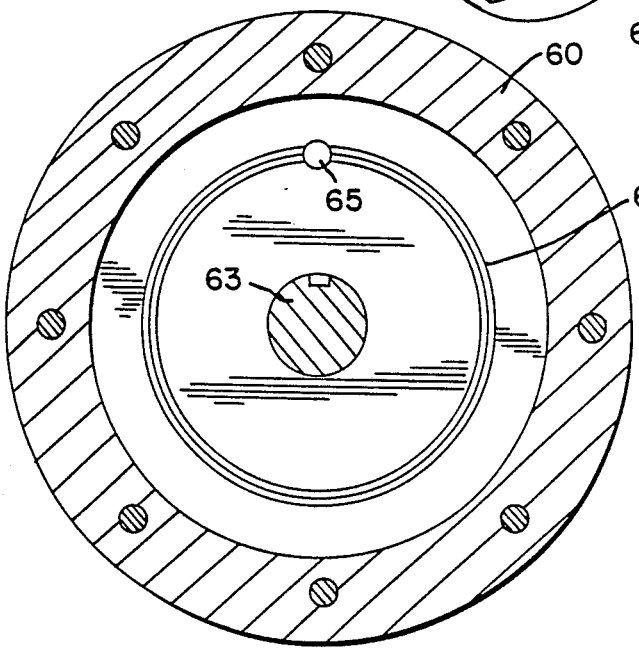
FIG. 6 is a transverse cross-sectional view of the fluid distributor of FIG. 4, taken along the line 6—6 of FIG. 5.
Figure 5:
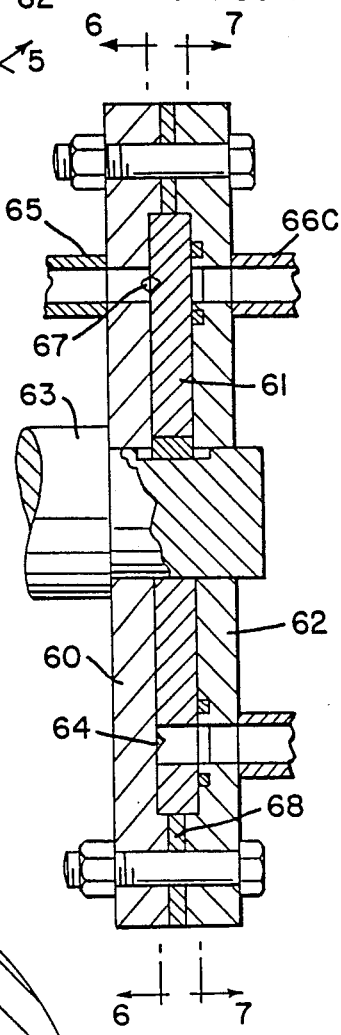
FIG. 5 is a longitudinal cross-sectional view of the fluid distributor of FIG. 4, taken along the line 5—5 thereof.
Figure 7:
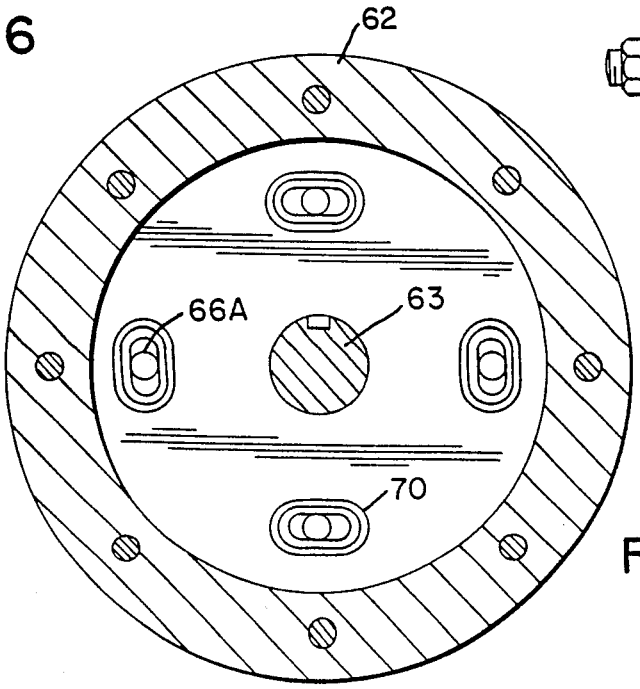
FIG. 7 is a transverse cross-sectional view of the fluid distributor of FIG. 4, taken along the line 7—7 of FIG. 5.

As best seen in FIGS. 2 and 3, spool valves 40 each include a tubular housing 66 having an interiorly-positioned, apertured sleeve 68 for controlling the flow through the valve of inlet or exhaust gases, depending upon the position of a valve spool 70, which is urged into the exhaust flow position, which is the position of the spool as shown in FIG. 3, by means of a compression spring 72. Valve spool 70 can be moved downwardly against the action of spring 72 to the inlet flow position to admit pressurized gas into the engine by shifting the spool in a downward direction, as viewed in FIG. 3, by introducing a pressurized actuating gas through aperture 74 so that the actuating gas acts against the upwardly facing surface of the spool 70, as pool 70 is shown in FIG. 3. As will be more fully explained hereinafter, a gas distributor 59 (see FIG. 1) controls the flow of actuating gas and communicates with respective valves 40 through respective conduits 66.

It is to be noted from FIG. 3 that inlet pipe 41, which can be on the order of one-half inch in diameter, extends from the inlet manifold 38 and conveys pressurized inlet gas to the one-half inch diameter pipe 42 and its associated cylinder 44 only when spool 70 has been moved downwardly, as viewed in FIG. 3, by actuating gas pressure introduced through aperture 74 to force spool 70 to its bottom position against the resistance of spring 72.

When the actuating gas pressure acting through conduit 66 is cut off, spool 70 returns to the exhaust position shown in FIG. 3, whereupon the working gas in associated engine cylinder 44 is exhausted through pipes 42 and 47 (see FIG. 2), each of which can be about one half inch in diameter, junction 49, spool valve 40, and larger size, about one-inch diameter, exhaust pipe 48. Dual exhaust pipes 42 and 47 extending from each of the engine cylinders through respective junctions 49 reduce the back pressure on the engine to improve efficiency.

Gas distributor 59 is a camless, rotary, fluid-operated distributor timing mechanism that is provided to control the flow of actuating gas used to move spools 70 in each of spool valves 40, to control the flow of inlet and exhaust gases to and from the respective cylinders. Referring to FIGS. 4 through 8, a pair of outer plates 60 and 62 is provided, and an inner plate 61 is positioned between the respective outer plates. Innermost plate 61 is in the form of a disc that is journaled for interior rotation between plates 60 and 62 by means of an outwardly extending shaft 63 that is driven from the engine output shaft through a suitable drive arrangement of a type that is well known to those skilled in the art. Disc 61 includes a radially offset aperture 64 to distribute fluid from a fluid inlet 65 to individual ones of respective valve outlet conduits 66A to 66D. An internal annular groove 67 is provided in outer plate 60 and is in communication with fluid inlet 65. The inlet gas within groove 67 is distributed to respective ones of outlet conduits 66A to 66D by the rotation past the respective conduits of aperture 64 while internal disc 61 is rotating relative to plate 62. An annular gasket 68 is positioned between plates 61 and 62 to provide a seal therebetween so that fluid does not leak from between the plates when they are assembled by means of bolts 69. Note that the rate of flow of fluid through gas distributor 59 can be controlled over a desired arc of rotation by providing plate 62 with arc-like channels 70 adjacent the outlet conduits 66.

Referring once again to FIG. 1, the source of the actuating gas for actuating the spools in the spool valves is pressure tank 28. A conduit 102 extends from tank 28 to gas distributor 59 and includes a pressure regulator 103, and conduit 65 extends from the pressure regulator to the distributor.

Figure 9:
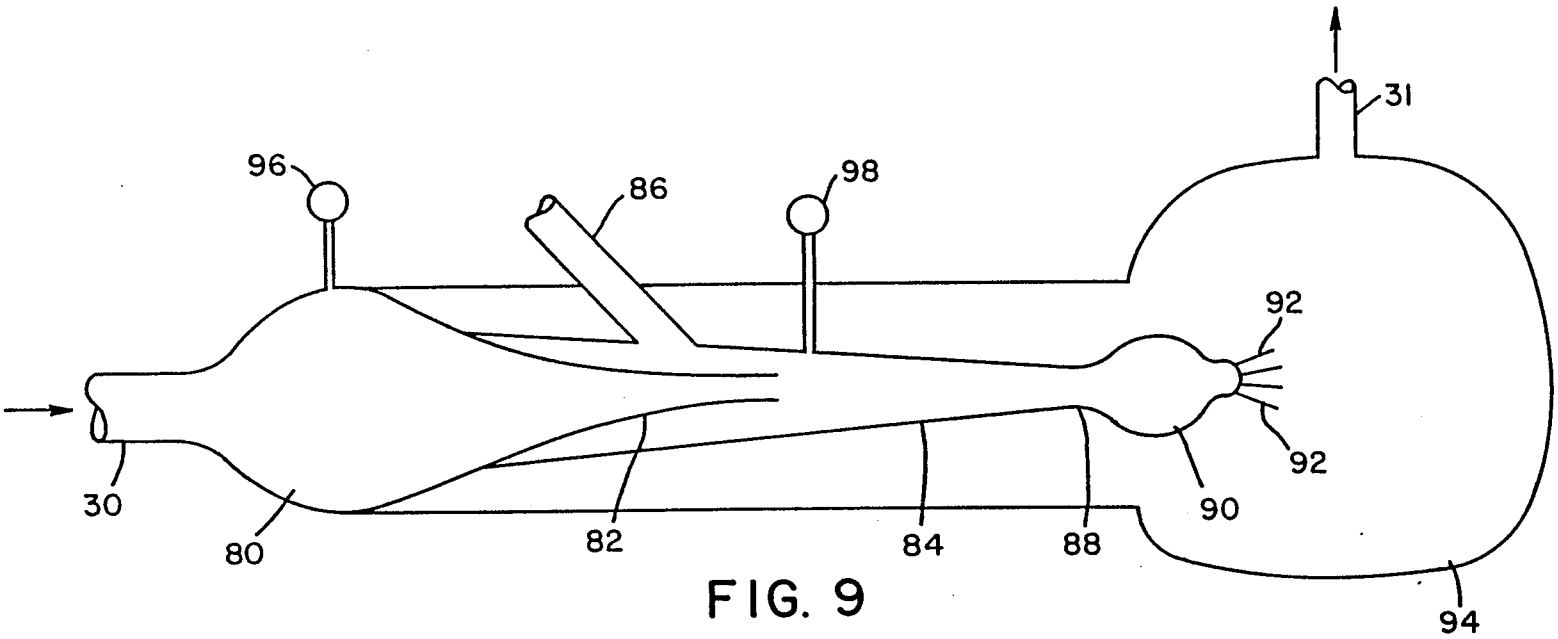
FIG. 9 is an enlarged, fragmentary, cross-sectional, schematic view of a mixing valve for mixing inlet and recirculated exhaust gases before introduction into the engine.

Referring now to FIG. 9, there is shown an interior view of recirculation device 35, which includes an ejector pump to draw exhaust gas into the device for mixing with the inlet gas. As shown, inlet pipe 30 conveys the pressurized inlet gas from the source (not shown) into a first chamber 80, which is of generally diverging-converging configuration to briefly expand and then increase the velocity of the incoming gas by passing it through a first converging nozzle 82. At the outlet of converging nozzle 82, which has a substantially smaller cross-sectional area than that of inlet pipe 30, the inlet gas issues into a second converging nozzle 84, which is in communication with the exhaust system through recirculation passageway 86, to permit a portion of the exhaust gas from the engine to be recirculated to the inlet system for mixing with inlet gases. Second converging nozzle 84 terminates at a throat 88 which communicates with a downstream first expansion chamber 90, within which the inlet and exhaust gases intermix. First expansion chamber 90 includes a plurality of small diameter outlet tubes 92 or openings that extend in a downstream direction and serve to increase the velocity of the gas mixture and to discharge it at high velocity into a second expansion chamber 94, where further mixing takes place. The mixture of inlet and exhaust gases is conveyed to the pressure tank 28 through conduit 31. pressure gauges 96 and 98 can be provided to monitor the gas pressure in first chamber 80 and in second converging nozzle 84, respectively, to enable an operator to maintain control of the amount of exhaust gas that is recirculated and thereby to control the pressure of the inlet gas that is introduced into the engine.

In operation, the inlet pressurized gas, which can have a pressure of from about 300 to about 800 psi, and can be obtained from, for example, a natural gas supply pipe or a natural gas well, passes into inlet pipe 30 and then into recirculation device 35. The inlet gas expands slightly in first chamber 80, and then its velocity is increased as it passes through and issues from first converging nozzle 82, from which it issues as a high velocity jet. As a result of the high velocity at the outlet of first converging nozzle 82, a reduced pressure zone results adjacent the outlet of the first converging nozzle, and as a consequence of that reduced pressure some of the exhaust gas within exhaust tank 52 is drawn into the recirculation device through recirculation passageway 86. The quantity of flow of exhaust gas is regulated by the operation of valve 57, which controls the back pressure that is imposed upon the exhaust system. As a result, the higher the pressure in the exhaust system, the greater the flow of exhaust gas in the recirculation device, and the greater the percentage of exhaust gas as a function of the inlet gas.

After the exhaust gas is drawn into second converging nozzle 84 it mixes with inlet gas as it is carried along with the high velocity jet of inlet gas issuing from first converging nozzle 82. The gas mixture then passes into throat 88 of second converging nozzle 84, whereupon the gas mixture expands in first expansion chamber 90 to provide additional mixing between the gases. The gases then issue through small diameter passageways 92, which can have a diameter of about 3/16 inch, and the gas mixture then expands within second expansion chamber 94, which serves as a plenum to provide a uniform pressure mixture of the inlet and exhaust gases, from which the gases are conveyed by pipe 31 to pressure tank 28.

Figure 10:
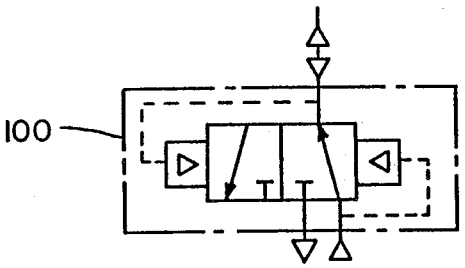
FIG. 10 is a schematic view of a quick acting exhaust valve that is connected to and that speeds operation of the spool valve.

Positioned within conduit 66 connected with each of the respective spool valves 40 for each cylinder (see FIG. 2) is a quick-acting exhaust valve 100, the schematic diagaram for which is shown in FIG. 10. Valve 100 serves to more rapidly release the pressure acting on spool 70 within spool valve 40 to permit more rapid movement of the spool to the exhaust position and more rapid changeover of valve 40 from an inlet flow condition to an exhaust flow condition by releasing the pressure that acts against the restoring force of spring 72, in order to permit spring 72 to move the spool into the exhaust position more quickly, and thereby more quickly permit the exhaust gas from the engine to enter exhaust tank 52. An example of a suitable quick exhaust valve is a flexible-diaphragm-type valve designated as valve series 3640, and manufactured by Mead Fluid Dynamics Division, Abex Corp., Chicago, Ill. As will be appreciated by those skilled in the art, other types of quick exhaust or dump valves can also be used, if desired, to provide similar results.

Although the present invention has been illustrated and described in the context of an in-line engine, a radial-type engine of the type disclosed in U.S. Pat. No. 4,507,918 could also be used. In that regard, the disclosures of applicant's U.S. Pat. Nos. 3,925,984; 4,162,614; and 4,507,918 are incorporated herein by reference to the same extent as if fully rewritten herein, to provide additional structural and operational details of engines and related equipment and apparatus that can be used with pressurized-gas-type engines of the type herein disclosed.

Thus the present invention is an improvement over pre-existing pressurized-fluid-operated engines in that it enables regulation of inlet gas pressure by permitting the introduction of lower pressure exhaust gas with the inlet gas to the engine by intermixing of the exhaust gas with the inlet gas. In that connection, the disclosed arrangement has particular utility when the source of inlet gas is the pressurized gas in a gas well, which typically has a high pressure, but does not involve a substantial volume of gas. The arrangement herein disclosed permits the pressure of the inlet gas to the engine to be maintained at a relatively high level, while providing the necessary volume so that the output of the engine will satisfactorily drive the load to which it is connected.

Although particular embodiments of the present invention have been illustrated and described, it will be apparent to those skilled in the art that changes and modifications can be made without departing from the spirit of the present invention. It is therefore intended to encompass within the appended claims all such changes and modifications that fall within the scope of the present invention.

What is claimed is:

1. A pressurized-fluid-operated reciprocating engine for providing output power by use of a pressurized gas that expands within the engine without combustion, said engine comprising:

a. an engine block having a plurality of cylinders within which respective pistons are reciprocatable to provide a rotary power output;

b. gas inlet means connected with the engine block for introducing a pressurized gas into the respective cylinders in a predetermined, timed relationship to provide a smooth power output from the engine;

c. gas outlet means connected with the engine block for conveying exhaust gas from the respective cylinders after the gas has expanded to move the pistons within the cylinders; and d. recirculation means extending between the inlet means and the outlet means for recirculating a predetermined quantity of exhaust gas, the recirculation means including ejector means for drawing exhaust gas into the recirculation means, first expansion chamber means downstream of the ejector means for mixing inlet and exhaust gas, and second expansion chamber means downstream of the first expansion chamber means for additional mixing and partial expansion of the gas mixture for introduction into the respective cylinders.

2. An engine in accordance with claim 1 wherein the gas inlet means includes individual spool valves connected with respective engine cylinders to selectively permit pressurized inlet gas to enter a cylinder and to permit exhaust gas to exit from a cylinder after the inlet gas within the cylinder has been expanded to provide output power.

3. An engine in accordance with claim 2 wherein the spool valves each include a spool housing and a spool slidable within the spool housing between an inlet position and an exhaust position, spring means at one end of the spool to urge the spool into the exhaust position and a chamber on the opposite side of the spool for receiving actuating gas for urging the spool into the inlet position, and quick acting valve means in communication with the chamber for rapidly exhausting spool actuating gas to permit the spool to rapidly be moved into the exhaust position by the spring means.

4. An engine in accordance with claim 3 wherein the gas inlet means includes a rotary distributor means for sequentially providing pressurized actuating gas to respective spool valves to move the spools from the exhaust position to the inlet position.

5. An engine in accordance with claim 4 wherein the distributor means includes a housing having an inlet and a plurality of outlets, each outlet communicating with a respective spool valve, and a disc rotatably carried within the housing between the inlet and the outlets, the disc including an aperture alignable inlet and the outlets, the disc including an aperture alignable with each outlet to sequentially admit pressurized actuating gas to respective spool valves as the disc rotates within the housing.

6. An engine in accordance with claim 1 wherein the ejector means includes a first converging nozzle connected with the inlet means, a second converging nozzle positioned downstream from the first converging nozzle and in communication therewith, and a recirculating gas passageway extending from the gas outlet means to the second converging nozzle for admitting exhaust gas into the second converging nozzle, the second converging nozzle having a throat positioned at an inlet to the first expansion means.

7. An engine in accordance with claim 6 wherein the first expansion chamber means includes a plurality of outlet tubes that communicate with the second expansion chamber means.

8. An engine in accordance with claim 7 wherein the outlet tubes extend into the interior of the second expansion chamber means.

* * * * *